US010575581B1

(12) United States Patent
Ooi

(10) Patent No.: US 10,575,581 B1
(45) Date of Patent: Mar. 3, 2020

(54) HELMET FORCE MITIGATION SYSTEM

(71) Applicant: Kuo Ooi, Rocklin, CA (US)

(72) Inventor: Kuo Ooi, Rocklin, CA (US)

( * ) Notice: Subject to any disclaimer, the term of this patent is extended or adjusted under 35 U.S.C. 154(b) by 140 days.

(21) Appl. No.: 15/794,480

(22) Filed: Oct. 26, 2017

Related U.S. Application Data

(60) Provisional application No. 62/415,305, filed on Oct. 31, 2016.

(51) Int. Cl.

| | |
|---|---|
| ***A42B 1/24*** | (2006.01) |
| ***A42B 3/04*** | (2006.01) |
| ***A41D 13/05*** | (2006.01) |
| ***A42B 3/14*** | (2006.01) |
| *A41D 13/015* | (2006.01) |
| *A42B 3/12* | (2006.01) |
| *A63B 71/10* | (2006.01) |
| *A63B 71/12* | (2006.01) |

(52) U.S. Cl.
CPC ..... *A42B 3/0473* (2013.01); *A41D 13/0512* (2013.01); *A42B 3/0433* (2013.01); *A42B 3/145* (2013.01); *A41D 13/015* (2013.01); *A42B 3/121* (2013.01); *A42B 3/125* (2013.01); *A63B 71/10* (2013.01); *A63B 71/12* (2013.01)

(58) Field of Classification Search
USPC ..... 2/422
See application file for complete search history.

(56) References Cited

U.S. PATENT DOCUMENTS

| | | | | |
|---|---|---|---|---|
| 6,442,767 | B1 * | 9/2002 | Meckes | A42B 3/22 2/10 |
| 7,941,873 | B2 * | 5/2011 | Nagely | A42B 3/0473 2/425 |
| 2013/0305436 | A1 * | 11/2013 | Castillo | A42B 3/0473 2/421 |
| 2014/0143941 | A1 * | 5/2014 | Heath | A42B 3/0473 2/422 |
| 2017/0065016 | A1 * | 3/2017 | Chuback | A42B 3/0473 |
| 2017/0266536 | A1 * | 9/2017 | Sciortino | A41D 13/0155 |

* cited by examiner

*Primary Examiner* — Timothy K Trieu
(74) *Attorney, Agent, or Firm* — Heisler & Associates

(57) ABSTRACT

A tilt resistor is interposed between shoulder pads or other torso support structures and a helmet. The helmet is coupled to one side of the tilt resistor and the torso support is coupled to another side of the tilt resistor. The tilt resistor acts as a pivot joint allowing the helmet to tilt about a horizontal lateral axis relative to the torso support. An acceleration sensor associated with the tilt resistor locks the tilt resistor so that the helmet stops tilting when tilting acceleration sensed by the accelerometer is greater than a desired maximum amount. The tilt resistor is coupled to the torso support, preferably through a collar, which allows rotation of the tilt resistor about a vertical axis. Stops are provided to limit both rotation about a vertical axis and tilting motion within limited ranges that are preferably adjustable.

12 Claims, 3 Drawing Sheets

HELMET FORCE MITIGATION SYSTEM

CROSS-REFERENCE TO RELATED APPLICATIONS

This application claims benefit under Title 35, United States Code § 119(e) of U.S. Provisional Application No. 62/415,305 filed on Oct. 31, 2016.

FIELD OF THE INVENTION

The following invention relates to helmets and other headgear and associated systems for minimizing head injuries. More particularly, this invention relates to helmet support systems which limit helmet movement, including rates of helmet acceleration and amount of helmet and associated head tilt and rotation, especially for protection of sports activity participants, such as football, hockey and lacrosse players.

BACKGROUND OF THE INVENTION

Many sports and other activities present a significant risk of concussion. When one receives a blow to the head which has sufficient force and associated acceleration, these forces can be transmitted to the brain and adjacent cranial structures with sufficient magnitude to result in trauma, including bleeding and potentially other damage. It is known to utilize a helmet worn by an individual so that when blows to the head are received, forces associated with the blow are absorbed somewhat by the helmet. However, the wearing of helmets has not been entirely effective in stopping or even significantly reducing the occurrence of concussions and related traumatic brain injuries (as well as neck injuries).

For instance, when playing football, all of the players wear a helmet which covers the head and includes significant padding and other absorbing layers inside a hard outer shell. In spite of the wearing of such helmets, concussions still occur and are a significant problem. In amateur boxing, while headgear including padding was previously required, evidence has been increasingly showing no benefit to such padding, and even to some extent potential for increased harm. Thus for instance, in the 2016 Olympics the boxing events took place without any headgear being utilized.

Accordingly, a need exists for improved head protection, such as helmet systems which are more effective in mitigating the forces transmitted to cranial structures of a wearer when an impact is sustained.

SUMMARY OF THE INVENTION

In analyzing the problems associated with concussion, and especially concussions occurring even when protective helmets and other headgear are worn, the inventor has noted a correlation between a ratio of head size to neck diameter. Head size typically correlates with head mass. Also, head size determines a distance that a center of mass of the head of an individual is spaced from the neck of the individual. Neck diameter is to some extent correlated with neck strength, in that an individual with a stronger neck will have more developed neck muscles which will result in a larger neck diameter. When a blow is received to the head, the strength of the individual's neck will have an impact on how much acceleration the head of the individual will undergo.

Also, the size of the individual's head will influence the acceleration experienced by the head of the individual. If the individual has a stronger neck, the acceleration experienced by the head of the individual when experiencing a blow will be decreased. Similarly, if the strength of the individual's neck is lesser, typically correlating with a smaller diameter neck, the head of the individual will undergo greater acceleration. Also, if the head of the individual is smaller the distance of a center of gravity of head of the individual from the neck where the head pivots, will be reduced. This will in turn decrease the acceleration which is typically experienced by a blow to the head. With lesser acceleration, corresponding forces within cranial structures of the individual and cranio-vertebral junction injuries will be reduced when a blow is experienced.

Neck injuries also can be exacerbated by the weight of the helmet and when the face guard or other structures of the helmet are grabbed or otherwise caused to move in a manner stressing the wearer's neck. This invention resists the motions that lead to both head and neck injuries, including neck injuries associated with excessive flexion or extension.

One goal of this invention is to provide a system which decreases acceleration experienced by a head of an individual so that forces within the cranium of the individual will be reduced. Generally, this system includes an intermediate structure between a helmet and shoulder pads (or other torso support structures) worn by an individual. The helmet and shoulder pads could be of a type typically worn by football players. As an alternative, the head and shoulder pads could be associated with those of a hockey player, a lacrosse player, or a player in any of a variety of other sports. Furthermore, such a helmet and shoulder pad (or torso support) system could be worn by workers in environments where blows to the head are potentially experienced (e.g. construction) or could potentially be utilized for everyday activities perhaps for individuals with a recovering brain injury or other condition which warrants utilization of a system to greatly reduce acceleration of the head relative to the individual's body.

The intermediate structures between the shoulder pads and the helmet include at least one of two basic subcomponents including a tilt resister and a rotation resister. In a preferred form of this invention, both the tilt resister and rotation resister are provided. However, the tilt resister could be provided alone without the rotation resister or the rotation resister could be provided alone without the tilt resister in various embodiments of this invention where such a system would be considered to be beneficial. In this application, tilt is considered to be rotation about a horizontal axis extending lateral to the individual, such as extending from the left and right sides of the individual's head. Thus, tilt is referred to as that pivoting motion which involves the individual nodding up and down. The rotation resister limits rotation about a vertical axis.

The system also generally limits helmet motion to "tilt" and "rotation." By limiting helmet movement to these two "degrees of freedom" the system will significantly reduce the head snapping motion, or "whiplash," that occurs during impact that contributes to the contrecoup injuries to the brain. A big part of concussion is the contrecoup forces that are transmitted to the brain. It is not just direct trauma that causes the concussion at the site of impact, but the contrecoup forces that injures the brain on the opposite side as well. By first restricting motion to the tilt and rotation (and possibly allowing some lateral tilting) and then providing the tilt resister and the rotation resister, the system will work to decrease concussions and other head/neck injuries.

The tilt resister is a structure which joins a helmet interface of the system with a collar interface of the system. The helmet interface is a rigid structure which extends up from the tilt resister and connects to the helmet. Preferably this helmet interface includes telescoping upper and lower halves which can be adjustable to adjust elevation of the helmet relative to the tilt resister for height adjustability. Preferably, this helmet interface also allows for disconnecting of the helmet from other portions of the system, such as when the helmet is being removed.

The tilt resister located between the helmet interface and the collar interface is preferably located at a point which is ideal for the center about which the head of the individual would normally tilt, relative to the individual's torso. The goal of the tilt resister is to allow tilting to occur freely except when two potentially undesirable circumstances are encountered. First, the tilt resister resists tilting if rapidly accelerating rotation is encountered which includes an acceleration above a maximum safe amount. Second, the tilt resister optionally but preferably acts to decrease a total amount of tilt which is allowed by the tilt resister. Between these rotational limits, the tilt resister does not impede tilt, but when one of these limits is reached, the tilt resister stops (or at least partially impedes) the ability of the helmet to tilt further relative to the shoulder pads. Thus, a football player (or other sports player or other user of the system of this invention) can freely tilt the individual's head except when excessive acceleration is encountered or when rotation beyond a desired amount is encountered.

To achieve free rotation, the collar interface and helmet interface preferably come together at the tilt resister through a roller bearing. This roller bearing can include a series of balls (or cylinders) which roll between an outer race and inner race to allow for free tilt and with the helmet interface coupled to an inner race of the bearing and with the collar interface coupled to an outer race of the bearing (or vice versa). While roller bearings are shown, other forms of bearings or joints could be utilized (pin joints, journal bearings, air bearings, slide bearing, etc.) with the goal being to allow free pivoting of the helmet relative to the shoulder pads in a tilt direction.

An acceleration limit is also provided within this joint between the helmet interface and the collar interface where the bearing is located. While various different systems could be utilized to sense acceleration and then resist or prevent tilting rotation within the tilt resister, one such system is disclosed herein in a preferred embodiment which is similar to a car seatbelt tensioner. A lock wheel is provided which is preferably coaxial with the bearing. This lock wheel has a series of teeth thereon. A claw structure is located adjacent to this lock wheel and has a sensor ball adjacent thereto. The sensor ball is allowed to float freely and moves when acceleration forces are encountered above a threshold amount.

When the sensor ball moves under such accelerations, the sensor ball causes the claw to pivot. When the claw pivots, the claw engages teeth on the lock wheel which cause the lock wheel to be prevented from further rotation. Thus, when a wearer of the system of this invention encounters a blow to the head, related acceleration causes the helmet to initially rapidly tilt about the tilt resister, and about the bearing. However, because rapid acceleration is encountered, the sensor ball also is caused to move, which causes the claw to be set against the teeth of the lock wheel and the lock wheel in turn locks the bearing between the collar interface and the helmet interface so that helmet rotation is stopped almost immediately after it starts. The forces associated with the blow to the helmet are thus carried not just by the helmet, but by a combination of the helmet and the shoulder pads (and thus the torso of the wearer) through the system. The head, neck and shoulders of the player are essentially immobilized in such an instance where the high acceleration forces have been encountered. High acceleration is thus not encountered by the cranial structures of the individual, and forces associated with the acceleration of cranial structures are mitigated.

While a single claw can be used in one embodiment, conceivably two claws could be provided, one for clockwise motion and one for counter-clockwise motion, so that blows to a front of the helmet or to a rear of the helmet would be similarly able to initiate locking of the lock wheel by engagement of one of the claws with teeth on the lock wheel and to prevent rotation of the tilt resister. The lock wheel can have teeth which are biased relative to the claw or could be symmetrical to be engaged by either claw (if two claws are provided in opposite directions), or two adjacent lock wheels can be provided with each claw able to engage one of the wheels, and the teeth on the wheels biased in opposite directions to facilitate locking when one of the claws is engaged by an acceleration of sufficient magnitude. Furthermore, blows to the side of the helmet are always resisted by the collar interface and helmet interface in that the tilt resister does not allow any tilt to the left and the right (about a horizontal axis extending forwardly and rearwardly relative to the head of the individual) or limits such lateral tilt but allowing it somewhat.

As an alternative to the sensor ball and claw, an accelerometer can be electrically coupled to a solenoid or other linear (or rotational) transducer, typically through a processor that also has a battery or other power supply. When an acceleration above a safe amount is sensed by the accelerometer, a signal is sent to the processor (or directly to the solenoid) which is configured to in turn power the solenoid to move a lock pin to engage the teeth of the lock wheel.

Preferably upper portions of the collar interface include tilt stops fixed thereon at approximately a 20° forward and 20° rearward position. These tilt stops are encountered by the helmet interface when the helmet interface pivots forward more than 20° or rearward more than 20°. These tilt stops preferably are adjustable to set a desirable limit for the amount of tilt which is accommodated by the tilt resister. If excessive rotation of the helmet in a tilt direction is encountered, these tilt stops are engaged and further tilt rotation is prevented. Forces which would otherwise be causing the head of the individual to tilt beyond this desired maximum amount would be transmitted to the shoulder pads and carried by the torso of the individual.

The collar interface is rigidly mounted to an inner race of a collar which also includes an outer race outboard of the inner race, with the outer race anchored to the shoulder pads. A series of bearings are provided between the inner race and outer race which allow the inner race to rotate about a vertical axis to accommodate rotation of the individual's head and helmet relative to the shoulder pads. The collar preferably has a hinge at a rear portion and a clasp at a front portion which can be opened to allow the collar to be placed over a head of an individual or otherwise allow for the shoulder pads to be put on the individual along with the collar. The clasp can be structured so that the inner race and outer race are made continuous when the collar is closed. As an alternative, the collar can be provided in two halves and the outer races can be merely arcuate sections of no more than 180° and with the inner races having a shorter length than the outer races so that rotation of the collar interface of the system can occur about a vertical axis and between the inner race and outer race left and right segments of the collar.

Such rotation is typically desirable to allow an individual wearing the helmet and shoulder pads to be able to rotate the individual's head to the left and to the right. However, it is desirable that such rotation be limited to not exceed an amount which could result in head and/or neck injury. To prevent over rotation, adjustable stops are provided on forward and rearward portions of either side of the collar interfaces. When these stops are encountered, further rotation is prevented.

In a preferred form of the invention, the stops are two part stops which include a base and a slide with a slight telescoping relative to the base and with a spring/damper between the slide and base. When the slide is encountered by the collar interface, the slide is compressed into the base and resistance to further rotation increases progressively as further and further rotation occurs. Such motion thus allows for a somewhat gradual stopping of rotation as the rotation limits are encountered.

OBJECTS OF THE INVENTION

Accordingly, a primary object of the present invention is to provide a system which blocks head tilting when a rate of tilting rotation accelerates beyond a desired maximum amount.

Another object of the present invention is to provide a system which resists motion of a helmet relative to shoulder pads or a torso support of a user when forces beyond a maximum amount are encountered.

Another object of the present invention is to provide a system which limits a maximum amount of head tilting and head rotation, such as to avoid amounts of tilting or rotation which exceed safe limits.

Another object of the present invention is to reduce the prevalence of concussions and other brain injuries when participating in sports which involve blows to the head.

Another object of the present invention is to provide a helmet force mitigation system which can be used with existing sports helmets with little or no modification to the helmets.

Another object of the present invention is to provide a method for mitigating the forces which are encountered by a head of a participant in athletic and other activities.

Another object of the present invention is to provide a helmet force and rotational position limiting system which is adjustable to adjust rotational ranges which are permitted and/or maximum accelerations which are permitted.

Other further objects of the present invention will become apparent from a careful reading of the included drawing figures, the claims and detailed description of the invention.

DESCRIPTION OF THE PREFERRED EMBODIMENT

Figure 1:
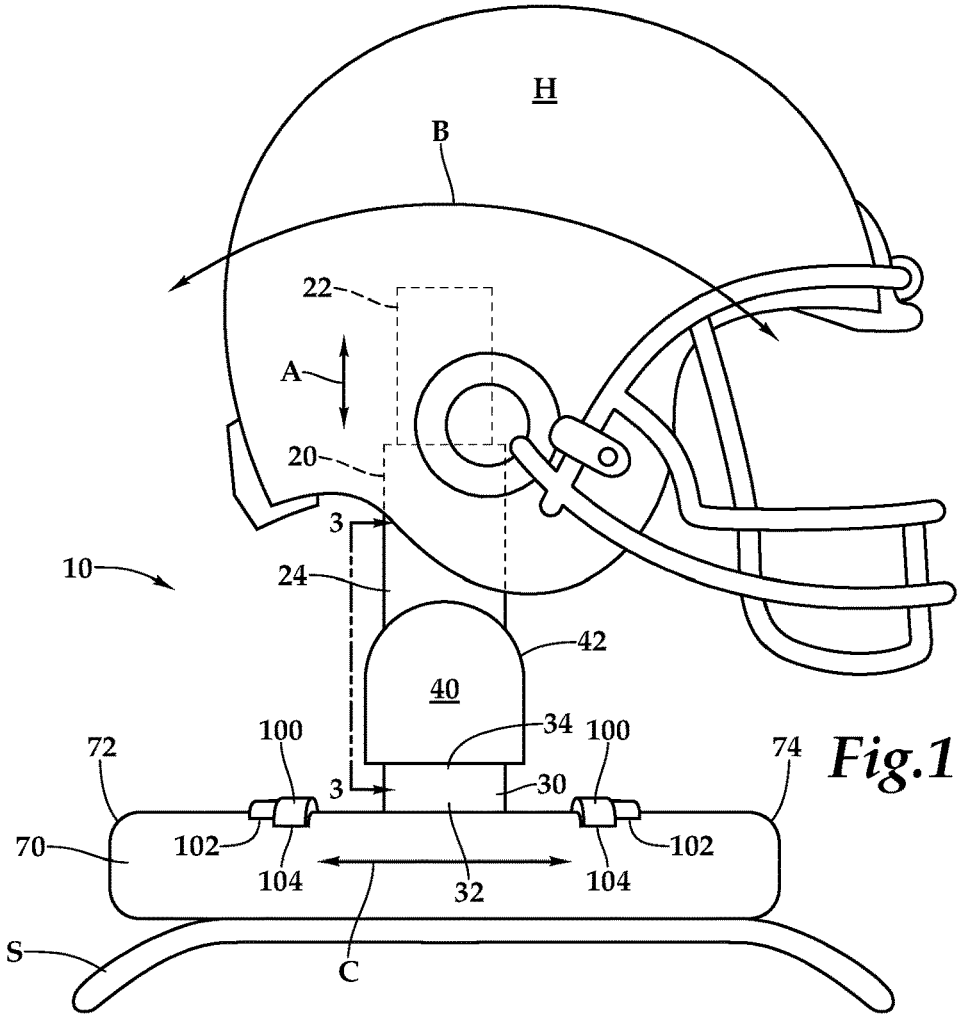
FIG. 1 is a side elevation view of a helmet and upper portions of shoulder pads, such as those which are utilized in the sport of football, and with a collar, tilt resistor, collar interface and helmet interface positioned for use according to this invention.

Referring to the drawings, wherein like reference numerals represent like parts throughout the various drawing figures, reference numeral 10 is directed to a helmet force mitigation system (FIGS. 1 and 4) for mitigating the potential for head trauma when forces are applied to the head of an individual, such as while engaging in a sports activity. The system 10 couples a helmet H to shoulder pads S (or other torso support) through a tilt resistor 40. The tilt resistor 40 includes an accelerometer, and allows tilting between the helmet H and head of the individual and the shoulder pads S or other torso support when no acceleration or acceleration below a threshold level is encountered. When acceleration above this threshold level is encountered, the tilt resistor 40 locks the helmet H to the shoulder pads S so that tilt of the helmet H relative to the shoulder pads S is prevented. The system 10 also optionally provides various stops to limit a maximum amount of tilt and/or a maximum amount of rotation about a vertical axis.

Figure 4:
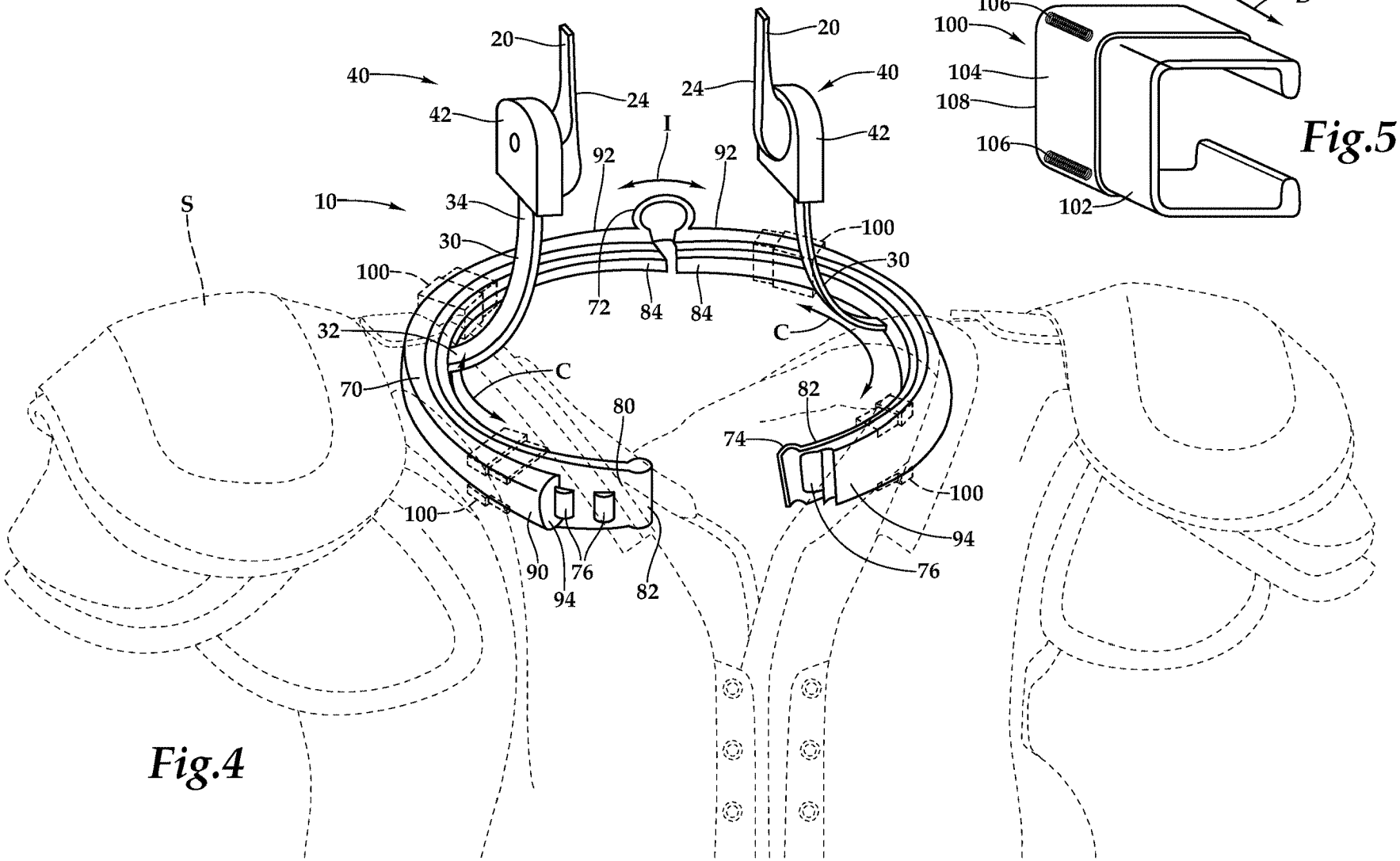
FIG. 4 is a perspective view of the system of this invention shone upon shoulder pads and with a helmet removed, and further illustrating how the system of this invention is configured according to one embodiment.

In essence, and with particular reference to FIGS. 1 and 4, basic details of the system 10 of this invention are described, according to an exemplary embodiment. The system 10 includes a helmet interface 20 which removably attaches to the helmet H, so that the helmet H can be readily removed from a head of an individual and readily attached and detached into the system 10. The system 10 also includes a collar interface 30 which is supported by collar 70 which in turn is supported by the shoulder pads S or other torso support worn by the individual. The collar interface 30 moves at least partially with the collar 70, preferably with the collar interface 30 able to rotate about a vertical axis while supported by the collar 70, but prevented from translation or other rotations relative to the collar 70.

The tilt resistor 40 is interposed between the helmet interface 20 and the collar interface 30. In simplified versions of the invention, the tilt resistor 40 could be interposed between the helmet H and shoulder pads S (or other torso support) through other intervening structures other than the helmet interface 20 and collar interface 30. The tilt resistor 40 supports a tilt joint between the helmet H and shoulder pads S which is a natural tilt joint for tilting of the head of an individual when the individual is wearing the helmet H and the shoulder pads S. This tilt resister 40 allows free tilting unless excessive acceleration is sensed by an accelerometer, or optionally also if tilting beyond a maximum allowed amount is exceeded.

In one embodiment, this tilt resistor 40 is constructed with a lock wheel 50 fixed to the helmet interface 20 and a bearing 60 between the helmet interface 20 and collar interface 30. A claw 54 is coupled to the collar interface 30 and interacts with a sensor ball 56 (or other sensor mass) which senses acceleration and which claw 54 moves and engages the lock wheel 50 to stop rotation between the helmet interface 20 and collar interface 30 when acceleration beyond a set maximum amount is exceeded. Alternatively, other accelerometers can be utilized and structures other than the lock wheel 50 utilized to lock and prevent tilt between the helmet interface 20 and collar interface 30 or other structures engaging the helmet H and shoulder pads S.

The collar 70 is preferably constructed with an inner race 80 and outer race 90 which allows the collar interface 30 to rotate about a vertical axis while also being supported by the collar 70. The collar 70 is preferably hinged about a hinge 72 which allows the collar 70 to open to a large extent and to facilitate donning and doffing of the shoulder pads S and collar 70 affixed thereto. Stops 100 are optionally attachable to the collar which limit an amount of rotation about a vertical axis that the collar interface 30 can experience relative to the collar 70.

More specifically, and with particular reference to FIGS. 1-4, details of the helmet interface 20 of the system 10 are described, according to this exemplary embodiment. The helmet interface 20 acts to connect the helmet H to the tilt Resister 40. In this exemplary embodiment, the helmet interface 20 includes an upper coupling 22 and a lower end 24. The upper coupling 22 is built into or attachable to the helmet H and the lower end 24 is separate from the helmet H. The upper coupling 22 and lower end 24 are configured to be removably attachable together. In one embodiment, the upper coupling 22 has a rectangular cross-section at a lower portion thereof and the lower end 24 has an upper portion thereof which is hollow and rectangular in cross-section, sized to receive the upper coupling 22 sliding into and out of the upper portion of the lower end 24 (along arrow A of FIG. 1), for removing the helmet H and associated upper coupling 22 of the helmet interface 20 from the lower end 24 and other portions of the helmet interface 20. In this way, the helmet H can be removed by an individual, leaving other portions of the system 10 worn by the individual.

The helmet H can be replaced upon the head of the individual by translating the upper coupling 22 of the helmet interface 20 (that is attached to the helmet H) down into the upper portion of the lower end 24. Preferably some form of clasp is provided which allows the upper coupling 22 and lower end 24 of the helmet interface 20 to be locked together, but releasable to allow them to slide relative to each other, such as by pushing a button which can be accessed within an interior of the helmet with enough force to disconnect the upper coupling 22 from the lower end 24 and allow the upper coupling 22 and helmet H to slide upward relative to the lower end 24. Such a clasp can in one embodiment have multiple attachment points at different elevations so that a height of the helmet H can be adjusted slightly. In another embodiment the clasp can be constructed so that it has one attachment point so that it is always attached precisely where desired.

Typically the upper coupling 22 is fitted just inside of an outer shell of the helmet H, and inboard of at least some of the padding within an interior of the helmet H. The upper coupling 22 can be custom fit it into the helmet H so that it causes the helmet H to be positioned relative to the pivot point of the tilt resistor 40 which causes the pivot point of the tilt resister 40 to be at a horizontal axis passing through the neck which matches a desired pivot point for the neck of the individual. In this way, when the helmet H is worn by the individual, the head and helmet H of the individual can easily and comfortably pivot upon the neck of the individual and with the helmet H pivoting through the helmet interface 20 about the pivot point within the tilt resistor 40 (along arrow B of FIGS. 1 and 2).

While the helmet interface 20 is shown with this particular configuration shown in the drawings, the helmet interface could be any form of interconnecting structure which interconnects a portion of the tilt resistor 40 to the helmet H. Also, while a football type helmet is depicted for the helmet H, other forms of helmets could be substituted, such as a hockey helmet, lacrosse helmet, construction hardhat or other protective headgear. While the helmet interface 20 is shown with the upper coupling 22 at least partially inside of an outer shell of the helmet H, this upper coupling 22 of helmet interface 20 could be on an exterior of the helmet H as an alternative.

Figure 2:
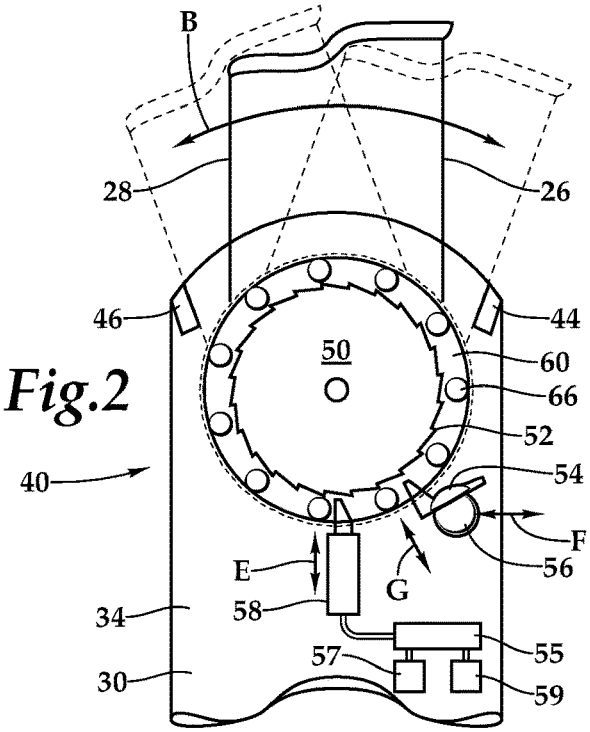
FIG. 2 is a detail of a portion of that which is shown in FIG. 1 showing interior functioning of the tilt resistor responsive to one of two different types of accelerometer sensors shown therein, and also showing tilt range stops for both limiting maximum acceleration and maximum tilt range for the helmet relative to the torso support.

With continuing reference to FIGS. 1 and 2, as well as FIG. 4, details of the collar interface 30 are described, according to this exemplary embodiment. The collar interface 30 is interposed above the collar 70 which attaches to the shoulder pads S (or other upper torso support structure) for the individual, and below the tilt resistor 40. The collar interface 30 holds the tilt resistor 40 in the position where it is required to be, adjacent to a horizontal tilt axis passing through a neck of an individual wearing the shoulder pads S, and so that the helmet H and helmet interface 20 can appropriately attach to the tilt resistor 40.

The collar interface 30 could conceivably be eliminated and the tilt resister 40 merely coupled directly to the shoulder pads S or other upper torso support structure. Most preferably a collar 70 is provided, which is attached to the shoulder pads S, and then the collar interface 30 extends up from this collar 70 to the tilt resistor 40. Such a configuration facilitates a collar 70 which includes an inner race 80 and outer race 90 which facilitate rotation about a vertical axis for the collar interface 30, and generally to facilitate an individual rotating the head from left to right without interference by the system 10 of this invention (unless dangerous rotation is encountered).

In one embodiment, the collar interface 30 includes a root 32 at a lower portion thereof which connects to the collar 70 and an apex 34 at an upper portion thereof. The apex 34 supports the tilt resister 40 and particularly portions of the tilt resistor 40 which are pivotably separate from portions of the tilt resistor 40 to which the helmet interface 20 and helmet H are attached.

In this particular embodiment, the collar interface 30 is elongate in form between the root 32 and the apex 34. This embodiment causes the collar interface 30 to have a curving form first extending substantially horizontally adjacent to the root 32 and extending inwardly towards a central vertical axis, and then curving upwardly so that the collar interface 30 extends approximately vertically as it approaches the apex 34. As an alternative, the collar interface 30 could extend linearly in a diagonal fashion from similar locations for the root 32 and the apex 34. Other forms of curves could similarly be provided, such as curves or straight sections in the collar interface 30 so that the tilt resistor 40 is positioned to allow the helmet interface 20 to be on an exterior of the helmet H rather than an interior.

The root 32 of the collar interface 30 is preferably affixed to a portion of the collar 70 which rotates (along arrow C of FIGS. 1 and 4) relative to an outer race 90 of the collar 70. In this way, the collar interface 30 has each of the two portions thereof on either side of the system 10 rotatable about a common vertical central axis, corresponding with an individual rotating the head from side to side about this vertical axis. As an alternative, the root 32 of the collar interface 30 could be affixed to the collar 70 and affixed to the shoulder pads S or other upper torso support, in which case, the helmet H would not accommodate head turning from side to side. As another alternative, head turning from side to side could be accommodated by a rotating interface above the tilt resistor 70 or within the collar interface 30.

Figure 3:
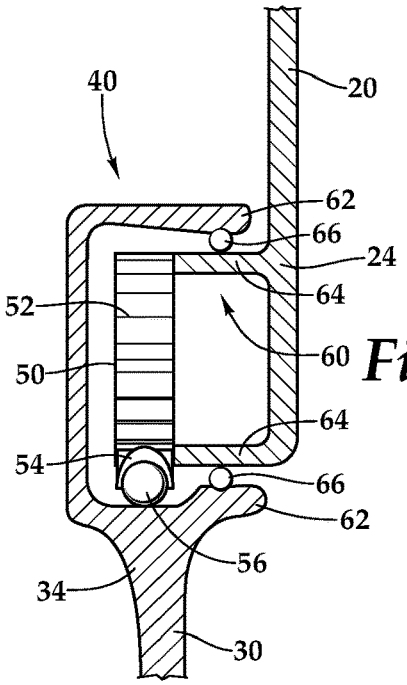
FIG. 3 is a full sectional front elevation view of the tilt resistor further illustrating how a lock wheel, claw, acceleration sensor ball mass, and bearing work together according to one embodiment of this invention.
Figure 5:
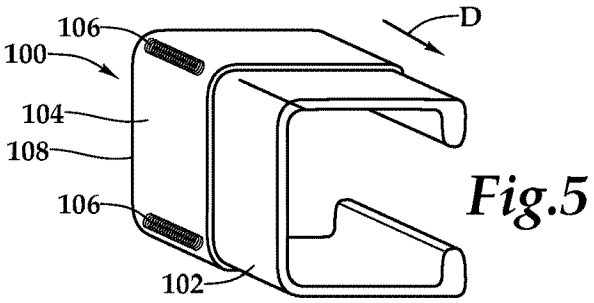
FIG. 5 is a perspective view of a stop attachable to a collar of the system of this invention to limit head rotation about a vertical axis relative to the torso of an individual upon which shoulder pads or other torso supports are carried.

With particular reference to FIGS. 1-3, details of the tilt resistor 40 are described, according to this exemplary embodiment. The tilt resistor 40 provides a tilt pivot joint between the helmet H and the shoulder pads S or other upper torso support worn by the individual who is wearing the helmet H. Most typically, the tilt resistor 40 is interposed between the helmet interface 20 and the collar interface 30, but could be interposed directly between the helmet H and shoulder pads S. The tilt resistor 40 generally has two portions which rotate relative to each other, one portion which is affixed (typically through intervene structures) to the helmet H and another portion which is affixed (typically through intervene structures) to the shoulder pads S.

In this exemplary embodiment, the tilt resister 40 includes a housing 42 which is fixed to the apex 34 of the collar interface 30 and thus through the housing 42 is coupled down to the shoulder pads S. A lock wheel 50 is rotatably supported within the housing of the tilt resister 40 by the bearing 60 and defines a separate portion of the tilt resister 40 which moves with the helmet interface 20 and with the helmet H in this exemplary embodiment. The housing 42 can include a complete enclosure associated therewith so that details such as the lock wheel 50 and bearing 60 are largely encased within this housing 42. FIG. 2 shows the tilt resistor 40 with at least a portion of this housing 42 cut away so that the lock wheel 50 and portions of the bearing 60 can be seen in operation. FIGS. 1 and 4 show the tilt resistor 40 with the full housing 42 in place and covering these elements of the tilt resistor 40.

Most preferably, the tilt resistor 40 is not only configured to sense acceleration and then to stop or resist tilting rotation when excessive acceleration is sensed, but also acts to resist tilting motion beyond maximum forward and maximum rearward tilting positions. To provide such limits to tilting rotation (along arrow B of FIGS. 1 and 2) a front tilt stop 44 and rear tilt stop 46 are both provided on the housing 42 of the tilt resister 40. When the helmet interface 20 and especially the lower end 24 of the helmet interface 20 pivots too far forward, it abuts the front till stop 44 and is prevented from any further rotation. When the helmet interface 20 pivots rearwardly and abuts the rear tilt stop 46, the helmet interface 20 is prevented from further rotation rearwardly. Rather, when the tilt stops 44, 46 are encountered, the helmet H and shoulder pads S all move together, acting somewhat like a headboard and splint for the individual when these stops 44, 46 are encountered. In this way, excessive tilting rotation, which might otherwise lead to a neck injury, are prevented. While the tilt stops 44, 46 are shown affixed to the housing 42 of the tilt resistor 40, they could alternatively be adjustable in position so that differing amounts of tilting motion could be accommodated by the tilt resister 40 between these boundaries.

The lock wheel 50 is also located within the tilt resistor 40 and generally fixed to the lower end 24 of the helmet interface 20, but with the lock wheel 50 positioned within a center of the tilt resistor 40 and held in this central position by the bearing 60. The lock wheel 50 acts as a portion of the selective locking system which causes the tilt resister 40 to transition from freely allowing tilt to preventing or resisting tilt. The lock wheel 50 has a series of teeth 52 extending from a peripheral edge thereof. The teeth 52 preferably are configured to have a biased form which allows the teeth 52 to pass freely past the teeth 52 in one direction but engages with locking structures when rotated in an opposite direction.

A claw 54 or other engagement structure for engaging the teeth 52 is located adjacent to the lock wheel 50. This claw 54 is pivotably (or slidably) supported in a manner which allows the teeth 52 to come into and out of engagement with teeth 52 of the lock wheel 50. A sensor mass, preferably in the form of a sensor ball 56, is located adjacent to the claw 54. When this sensor ball 56 pushes against the claw 54 with enough force, it causes the claw 54 to pivot and to engage the teeth 52 in the lock wheel 50 such that further rotation is prevented.

Figure 6:
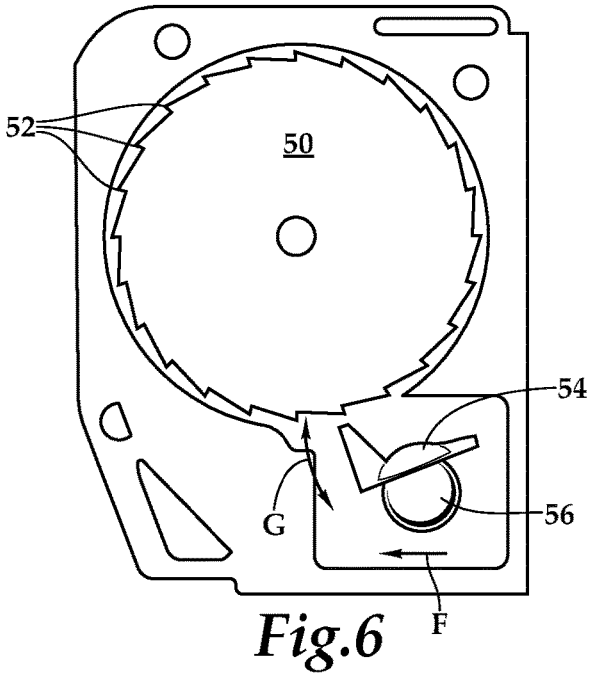
FIGS. 6 and 7 are side elevation detail views of one form of lock wheel and claw and sensor ball configuration showing how acceleration of the sensor ball causes engagement of the claw with teeth on the lock wheel when accelerations are sensed.
Figure 7:
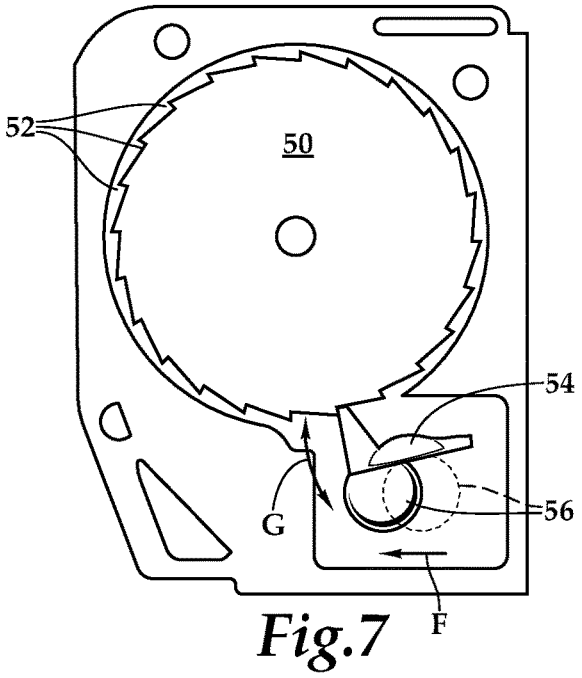

In particular, the sensor ball 56 senses forces such as those associated with accelerations of the head of the individual wearing the helmet H and utilizing the system 10, in the form of forces acting along arrow F (FIGS. 2, 6 and 7). If these forces F are sufficiently high in magnitude, the sensor ball 56 pushes against the claw 54 and causes the claw 54 to rotate (or translate/slide) along arrow G (FIGS. 2, 6 and 7), and come into engagement with the teeth 52 of the lock wheel 50. One should recognize that the force acting on the sensor ball 56 is actually inertia of the sensor ball 56 itself when the housing 42 of the tilt resistor 40 is moving forward rapidly and in an accelerating fashion. This acceleration in a forward direction acts on everything within the system 10 except for the sensor ball 56 which is free (due to inertia) to act on the claw 54 rather than moving with other portions of the system 10. Thus, the sensor ball 56 appears to have a force acting on it in a rearward direction. When the claw 54 engages the teeth 50 of the lock wheel 50, the lock wheel 50 is prevented from rotating in a counterclockwise direction which would be the direction that the lock wheel 50 would want to rotate since it is affixed to the helmet interface 20 into the helmet H, preventing helmet H from snapping backwards.

One can recognize that when a football player or other athlete or other individual is struck from behind with sufficient force, such a situation can cause the head of the individual to snap back. The system 10 of this invention prevents such snack back as follows. The rapid acceleration is "sensed" by the sensor ball 56 as coming from the rear of the individual, causing the sensor ball 56 to move rearwardly (along arrow F) and act on the claw 54, which in turn causes the claw 54 to rotate/translate along arrow G and to engage teeth 52 on the lock wheel 50. The lock wheel 50 is thus prevented from rotating in a counterclockwise direction which is corresponding with the associated helmet interface 20 and helmet H pivoting rearwardly (along arrow B). Thus, when such rapid acceleration associated with forces from the rear are encountered, the tilt resister 40 resists rapid tilting of the head and helmet H (in a rearward direction). Individuals are thus potentially saved from significant head injury, including concussion.

Blows can also come from the front. In one embodiment, the claw 54 and sensor ball 56 are configured, such as with prongs on either end thereof, which can each engage teeth 52 on the lock wheel 50 which teeth 52 could be provided without a biased form. As an alternative, two different lock wheels 50 could be nested side-by-side with teeth 52 biased in opposite directions so that when the claw 54 (or separate claws and sensor balls acting in opposite directions), are engaged by the claw 54, the lock wheel 50 is prevented from rotation in the same manner described in detail above for blows that come from the rear. The helmet H and head of the individual is thus prevented from rapid tilting motion when blows come from either the front or the rear in a preferred embodiment.

Blows also come to an individual from the side. The tilt resistor 40 and collar 70 do not facilitate much if any tilting in response to blows from the side. Thus, such blows from the side to the head H of an individual are transmitted from the helmet H through the helmet interface 20, through the tilt resistor 40, through the collar interface 30 and down to the shoulder pads S (and vice versa). Thus, the entire upper torso and head of the individual all share in absorbing these lateral forces, so that such forces are not concentrated just on the head of the individual and injury is minimized or avoided.

While the lock wheel 50 could be a single lock wheel as shown, two separate lock wheels 50 could be provided adjacent to each other with teeth 52 biased in opposite directions. As depicted in FIG. 3, a single lock wheel 50 could merely have teeth 52 biased in one direction on an outer side and in the other direction on an inner side, and the claw 54 could merely have prongs thereon which are slanted toward inward or outward directions laterally so that the prongs on the claw 54 engage the appropriate teeth 52 when the sensor ball 56 senses acceleration in the appropriate corresponding direction. Alternately, two entirely separate claws 54 and sensor balls 56 could be provided for forward acceleration detection and entirely separate lock wheels 50 (supported about a common centerline) can be fixed to the helmet interface 20 and resist tilting when excessive acceleration is encountered in either direction.

As an alternative to the sensor mass such as the sensor ball 56 and associated claws 54, other forms of acceleration sensors can be utilized to cause the tilt resister 40 to selectively go into a tilt resisting mode or a tilt allowing mode, depending on whether or not acceleration is sensed. As one option, a solid-state accelerometer 59 can be wired to a battery 57 processor 55, as well as the solenoid 58 or some other transducer or actuator, so that when acceleration is sensed, physical action occurs to engage the lock wheel 50 or other structure to prevent the lock wheel 50 or other structure from pivoting when such acceleration is experienced. FIG. 2 shows such an alternative where a solenoid 58 can move (along arrow E) to engage the teeth 52 on the lock wheel 50 when the accelerometer 59 senses acceleration above an acceptable level. These various electronics can be fitted into the housing 42 of the tilt resister 40.

The bearing 60 is preferably provided laterally and inwardly relative to the lock wheel 50 to facilitate the tilt resister 40 allowing free rotation and tilting of the head and helmet H of the individual when no dangerous accelerations are encountered. This bearing 60 in this embodiment includes an outer ring 62 fixed to the housing 42 of the tilt resistor 40, and also fixed to the collar interface 30, and the inner ring 64 which is fixed to the lock wheel 50 and to the lower end 24 of the helmet interface 20. Rollers 66 are interposed between these rings 62, 64 to allow the helmet H and helmet interface 20 to freely pivot in a tilting manner relative to the collar interface 30 and shoulder pads S, unless the lock wheel 50 is engaged in response to sensed acceleration to lock such rotation.

If desired, the lock wheel 50 could be coupled to the lower end 24 of the helmet interface 20 through a friction pad or clutch arrangement which would allow limited rotation of the lock wheel 50 relative to the helmet interface 20, so that when dangerous accelerations are sensed, rotation is not entirely prevented, but rather friction is interposed into the system to reduce such tilting rotation and to resist and slow down action of such tilting rotation. Typically, however, the lock wheel 50 is configured to entirely lock rotation when dangerous accelerations are encountered. The tilt resister 40 is preferably configured to be adjustable so that different sensitivity settings can be selected, such as safer settings when the system 10 is utilized by person who already has a head injury or has a condition with a weakened and greater susceptibility to concussion or other head injury. At the other end of the spectrum, an individual with a large and strong neck might choose to set a higher acceleration at which the tilt resister 40 would lock further tilting rotation.

With particular reference to FIGS. 1 and 4, details of the collar 70 are described, according to this exemplary embodiment. The collar 70 preferably includes left and right halves which are semi-circular in form and include a hinge 72 to join these two halves together at a rearward location. The collar 70 can preferably open slightly about this hinge 72, such that an open center can be enlarged, such as when an individual is donning the shoulder pads S and the collar 70, and closed after the shoulder pads S and collar 70 have been placed upon the individual, so the collar 70 forms a substantially complete circuit (FIG. 1). A clasp 74 can be provided at a forward opening which facilitates removable attachment for portions of the collar 70 opposite the hinge 72.

Rollers 76 are fitted into the collar 70 between an inner race 80 and outer race 90. The inner race 80 can thus rotate relative to the outer race 90 about a vertical axis. This allows the collar interface 30 and tilt resister 40 (coupled to the inner race 80) to rotate about a vertical axis and still be supported by the shoulder pads S. The inner race 80 includes rear ends 82 and front ends 84 in the form of two halves (left and right) of the collar 70. The outer race 90 has a rear end 92 and front end 94 in each of the two halves of the collar 70. The rear ends 92 of the outer race 90 of each of the two halves are attached to the hinge 72, so that the outer race 90 can pivot (about arrow I) to widen and narrow the collar 70. The outer race 90 preferably is longer than the inner race 80. The inner race 80 can move along the outer race 90 during such rotation about the vertical axis (about arrow C of FIG. 4). If desired, the two half portions of the collar 70 can be appropriately aligned so that the inner race 80 can cross over somewhat from the left side to the right side of the outer race 90, and vice versa, at either the front or rear of the collar 70. Most preferably, the inner race 80 is significantly shorter than the outer race 90, so such cross over is not needed.

Most preferably, stops 100 are provided on the collar 70 which can be adjustably placed and prevent the collar interface 30 and associated inner race 80 from rotating (along arrow C of FIG. 4) beyond the stops 100. As one example, four stops 100 can be provided on the collar 70 and positioned where desired to provide maximum clockwise and counterclockwise rotation for the head of an individual utilizing the system 10. Alternatively two stops 100 can be used on just one side or on just the front or just the rear of the collar 70.

In one embodiment, the stops 100 each include an inner clamp 102 which claims under the collar 70 and an outer sleeve 104 which can translate linearly over an outside of the inner clamp 102 at least somewhat. Preferably an energy absorption spring or damper 106 is provided between the inner clamp 102 and outer sleeve 104. A contact surface 108 on a portion of the outer sleeve 104 most distant from the inner clamp 102 is positioned to come into contact with the collar interface 30, when the collar interface 30 is rotated a maximum desired amount. When the contact surface 108 is impacted by the collar interface 30, the outer sleeve 104 is caused to translate (along arrow D) toward the inner clamp 102. The energy absorption spring or damper 106 resists such motion of the outer sleeve 104 relative to the inner clamp 102 to somewhat, so that the stops 100 do not provide an abrupt stopping of rotation of the collar interface 30 (along arrow C of FIG. 4), but rather a gradual stopping occurs as the spring or damper 106 is compressed. The inner clamp 102 can include a fastener, such as a set screw, which can be tightened or loosened so that the stops 100 can be placed where desired and then tightened in position, so that the stops 100 will not move inadvertently, but can have their positions adjusted.

Figure 8:
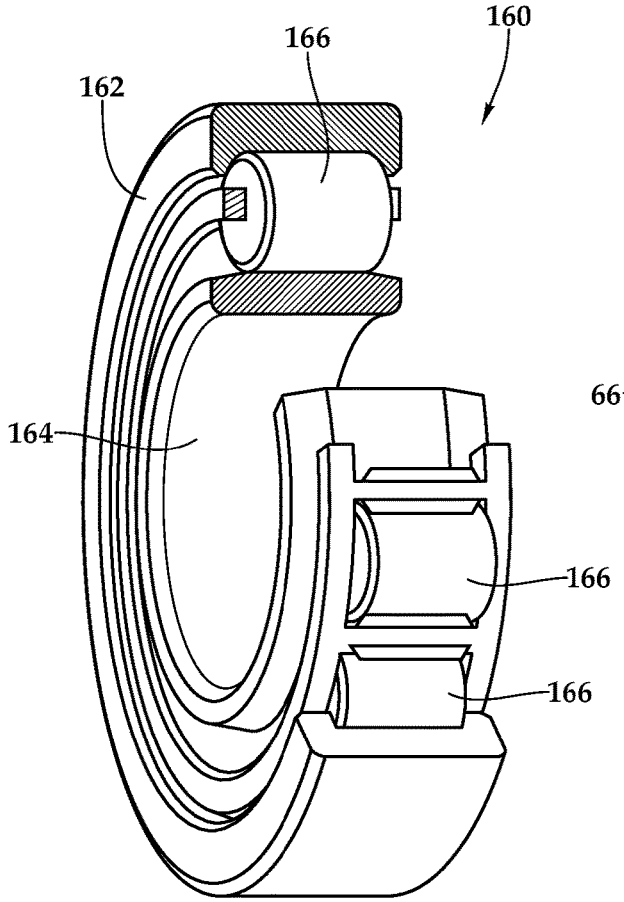
FIGS. 8 and 9 are perspective partially cut away views of two representative styles of bearings which can be utilized within the tilt resistor for tilting support and also for rotational support of the helmet relative to the collar and shoulder pads or other source of support.
Figure 9:
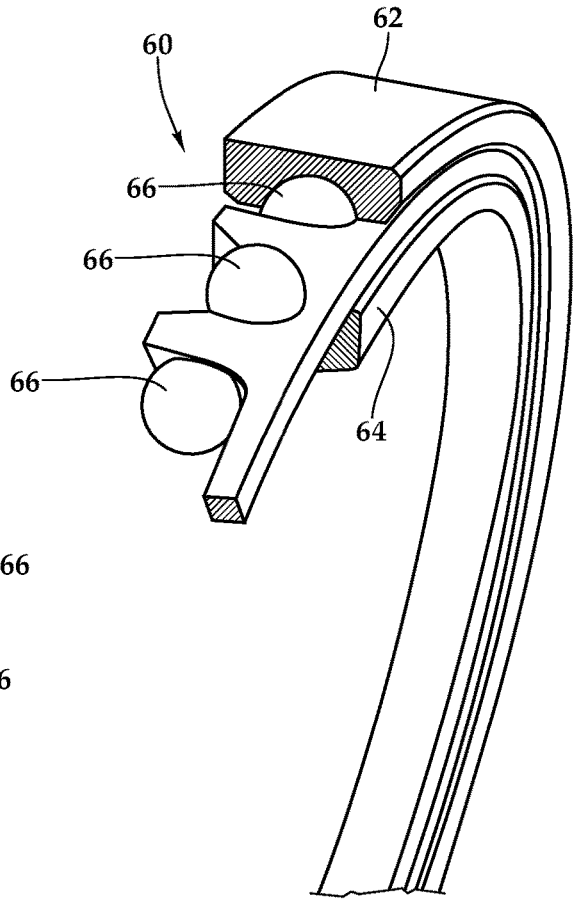

FIGS. 8 and 9 show two different variations of a bearing 60 which can be utilized within the tilt resistor 40, or exemplary of structures which could be adapted for use within the collar 70. In a FIG. 8 variation, the bearing is provided in the form of a cylindrical roller 166 within a bearing 160 with an inner race 164 and outer race 162. In FIG. 9 a bearing 60 is depicted with ball rollers 66 carried between an inner race 64 in an outer race 62.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A system for resisting excessive acceleration of a head of an individual relative to shoulders of an individual, the system comprising in combination:

a helmet configured to be wearable on a head of a wearer;

shoulder pads configured to be wearable upon shoulders of a wearer;

a helmet interface extending down from said helmet;

a collar interface extending up from said shoulder pads;

a tilt resister interposed between said helmet interface and said collar interface;

said tilt resister including an acceleration sensor, said acceleration sensor locking said collar interface in fixed position relative to said helmet interface when said acceleration sensor senses acceleration greater than a maximum set amount; and wherein said acceleration sensor includes a sensor mass adjacent to a moving claw, said moving claw positioned to move into and out of engagement with teeth on a lock wheel, responsive to forces applied by said sensor mass, with said claw and said lock wheel fixed to opposite ones of said helmet interface and said collar interface, such that when said claw engages said teeth on said lock wheel, said helmet interface and said collar interface are prevented from relative rotation, such that tilting is prevented.

2. The system of claim 1 wherein tilt stops are interposed between said collar interface and said helmet interface to prevent tilting of said helmet relative to said shoulder pads beyond a maximum desired amount.

3. The system of claim 2 wherein said tilt stops include a front tilt stop and a rear tilt stop, said front tilt stop limiting forward tilt motion for said helmet and said rear tilt stop limiting rearward tilt motion for said helmet.

4. The system of claim 3 wherein at least one of said front tilt stop and said rear tilt stop is adjustable in position to adjust an amount of tilt motion for said helmet.

5. The system of claim 1 wherein said tilt resistor includes a pivot joint between said helmet interface and said collar interface.

6. The system of claim 5 wherein said pivot joint of said tilt resistor includes a roller bearing including an outer ring fixed to a first one of said helmet interface or said collar interface and an inner ring fixed to a second one of said helmet interface or said collar interface, with a plurality of rollers between said outer ring and said inner ring.

7. The system of claim 1 wherein said sensor mass is a sensory ball and wherein said moving claw pivots about a pivot point with a prong associated with said claw pivoting into and out of engagement with teeth on said lock wheel.

8. A system for resisting excessive acceleration of a head of an individual relative to shoulders of an individual, the system comprising in combination:

a helmet configured to be wearable on a head of a wearer;

shoulder pads configured to be wearable upon shoulders of a wearer;

a helmet interface extending down from said helmet;

a collar interface extending up from said shoulder pads;

a tilt resister interposed between said helmet interface and said collar interface;

said tilt resister including an acceleration sensor, said acceleration sensor locking said collar interface in fixed position relative to said helmet interface when said acceleration sensor senses acceleration greater than a maximum set amount; and wherein said collar interface is rotatably supported by a collar portion of the shoulder pads, with the collar including an inner race and an outer race with the inner race rotating relative to the outer race, and with stops on said collar preventing rotation of said inner race relative to said outer race beyond said stops.

9. The system of claim 8 wherein said stops on said collar include at least two stops, one positioned to limit clockwise rotation about a vertical axis and one positioned to limit counterclockwise rotation about a vertical axis.

10. The system of claim 8 wherein said stops on said collar include at least four stops, two on a first side of said helmet and two on a second side of said helmet opposite said first side, said two stops on said first side of said helmet including one positioned to limit counterclockwise rotation about a vertical axis and one position to limit clockwise rotation about the vertical axis.

11. The system of claim 8 wherein said stops on said collar are adjustable in position.

12. A system for resisting excessive acceleration of a head of an individual relative to shoulders of an individual, the system comprising in combination:

a helmet configured to be wearable on a head of a wearer;

shoulder pads configured to be wearable upon shoulders of a wearer;

a helmet interface extending down from said helmet;

a collar interface extending up from said shoulder pads;

a tilt resister interposed between said helmet interface and said collar interface;

said tilt resister including an acceleration sensor, said acceleration sensor locking said collar interface in fixed position relative to said helmet interface when said acceleration sensor senses acceleration greater than a maximum set amount; and wherein said acceleration sensor is powered by an electric power source and coupled to a circuit which delivers power to a transducer which moves into and out of engagement with teeth on a lock wheel responsive to a signal from a circuit including said acceleration sensor, with said lock wheel and said transducer connected to opposite ones of said helmet interface and said collar interface, such that when said transducer is activated by said circuit coupled to said acceleration sensor, said transducer is selectively locked to said lock wheel, and in turn said helmet interface and said collar interface are locked from relative tilting motion therebetween.

* * * * *